US008276336B2

(12) United States Patent
Zatkulak

(10) Patent No.: US 8,276,336 B2
(45) Date of Patent: Oct. 2, 2012

(54) ARTICLE AND METHOD FOR CONTROLLING MOISTURE

(75) Inventor: Anthony D. Zatkulak, Midlothian, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 1927 days.

(21) Appl. No.: 11/132,869

(22) Filed: May 19, 2005

(65) Prior Publication Data

US 2006/0260265 A1 Nov. 23, 2006

(51) Int. Cl.
*E04B 1/70* (2006.01)

(52) U.S. Cl. ..... 52/302.1; 52/302.3

(58) Field of Classification Search ..... 52/95, 199, 52/302.1, 302.3, 408, 746.1, 746.11, 745.06
See application file for complete search history.

(56) References Cited

U.S. PATENT DOCUMENTS 2,839,789 A * 6/1958 Adams ..... 52/405.4
3,797,180 A * 3/1974 Grange ..... 52/95
4,096,790 A * 6/1978 Curran ..... 454/260
4,707,960 A * 11/1987 Bullock ..... 52/404.3
4,977,714 A * 12/1990 Gregory, Jr. ..... 52/95
5,885,909 A 3/1999 Rudisill et al.
6,548,431 B1 4/2003 Bansal et al.
6,797,655 B2 9/2004 Rudisill
6,831,025 B2 12/2004 Rudisill et al.
2006/0117686 A1* 6/2006 Mankell et al. ..... 52/302.1

OTHER PUBLICATIONS

British Board of Agrement Certificate No. 94/3054 (Apr. 23, 2004).*
British Board of Agrement Certificate No. 99/3648 (Mar. 28, 2003).*

* cited by examiner

*Primary Examiner* — Basil Katcheves

(57) ABSTRACT

A building construction method for controlling moisture in a building attic and improving the energy efficiency of the building achieved by installing a breathable membrane directly above the roof rafters thereby providing the presence of an air gap between the breathable membrane and the roof deck and sealing the membrane to the peripheral walls of the building, such that energy that normally passes from the living space into the attic and out the top of the building is conserved.

7 Claims, 4 Drawing Sheets

ARTICLE AND METHOD FOR CONTROLLING MOISTURE

BACKGROUND OF THE INVENTION

1. Field of the Invention

The invention relates to a building construction method for controlling attic moisture and improving the energy efficiency of a building by the installation of a breathable membrane in order to seal the attic space and provide an active air space between the attic and the roof deck.

2. Description of the Prior Art

In conventional building practices for construction of buildings having an attic space above the useful living space and below the roof, particularly buildings using wooden rafters and/or decking below the roof, the moisture level in the attic is typically controlled by ventilating the attic with air flow from the eaves of the building to the ridge vent at the highest point of the roof. As shown in FIG. 1, air is allowed to flow by means of convection from open spaces along the eaves (between the walls of the building and the bottom of the roof line) to the open space along the ridge(s) at the top of the roof, i.e., the ridge vent. This flow of air purges the attic of moisture before it can build up in the attic 2. Moisture commonly enters the attic from the living space in the form of vapor. Sources of moisture in the living space include human respiration, use of bathtubs and showers, cooking, houseplants, etc.

Typically, the attic 2 is open to the flow of air from the living space and from the exterior of the building surrounding the eaves. While this allows for good moisture control in the attic, it is often not energy-efficient since the living space 4 is not sealed and energy from the climate-controlled living space is permitted to leak to the exterior of the building through the ridge vent with the airflow.

Expandable foams have been used to insulate and seal the attic. The foams are sprayed under the roof decking and inside the roof rafters, or on the "floor" of the attic. While this can effectively seal the attic, this method does not prevent moisture from building up in the attic since the foams used are typically not breathable and do not permit air to flow through the attic, therefore this is not acceptable for many climates.

It would be desirable to provide a construction method that eliminates the exchange of air between the living space and the attic thereby providing good overall energy efficiency of the building, and that provides good control of moisture in the attic.

SUMMARY OF THE INVENTION

This invention is a method for controlling attic moisture and improving the energy efficiency of a building comprising peripheral walls and a roof comprising rafters having a ridge vent at the highest portion of the roof and eaves at the lowest portion of the roof, the method comprising:

installing a breathable membrane over the rafters, sealing the breathable membrane to the peripheral building wrap, installing a roof deck over the rafters, and providing an air space between the breathable membrane and the roof deck wherein the air space is open to the exterior of the building at the eaves and at the ridge vent of the building such that air is permitted to flow freely between the eaves and the ridge vent.

This invention is also the breathable membrane.

DEFINITIONS

The term "active air space" refers to an air space in which air is allowed to freely move both within the air space and in and out of the air space in response to conditions that influence air flow, e.g., thermal gradients.

The term "roof deck" is used interchangeably with the term "roof decking" and refers to the structural board on which roofing material (e.g., shingles) is installed, such as plywood or oriented strand board (OSB).

The term "eave" herein refers generally to the intersection between the roof and the wall of a building.

The term "ridge vent" herein refers generally to the space between differing planes of roof decking along their uppermost edges, typically protected by a cap.

The term "hip" herein refers to the intersection of multiple planes of roofing wherein the line or point of intersection is at the highest point relative to the height of the intersecting planes of roofing.

The term "valley" herein refers to the intersection of multiple planes of roofing wherein the line or point of intersection is at the lowest point relative to the height of the intersecting planes of roofing.

The term "peripheral building wrap" herein refers to the use of a flexible sheet material to wrap the unfinished walls of a building, such as a weather-resistive barrier.

The term "rafters" is used herein to refer to discrete structural load-bearing elements which form the upper portion of a building's attic (also commonly referred to as joists, beams, or trusses).

The term "counter battens" refers herein to elongated strips used in the installation of roofs, typically installed directly over the roofing trusses or rafters, each counter batten extending the length of the truss or rafter.

DETAILED DESCRIPTION OF THE INVENTION

Figure 1:
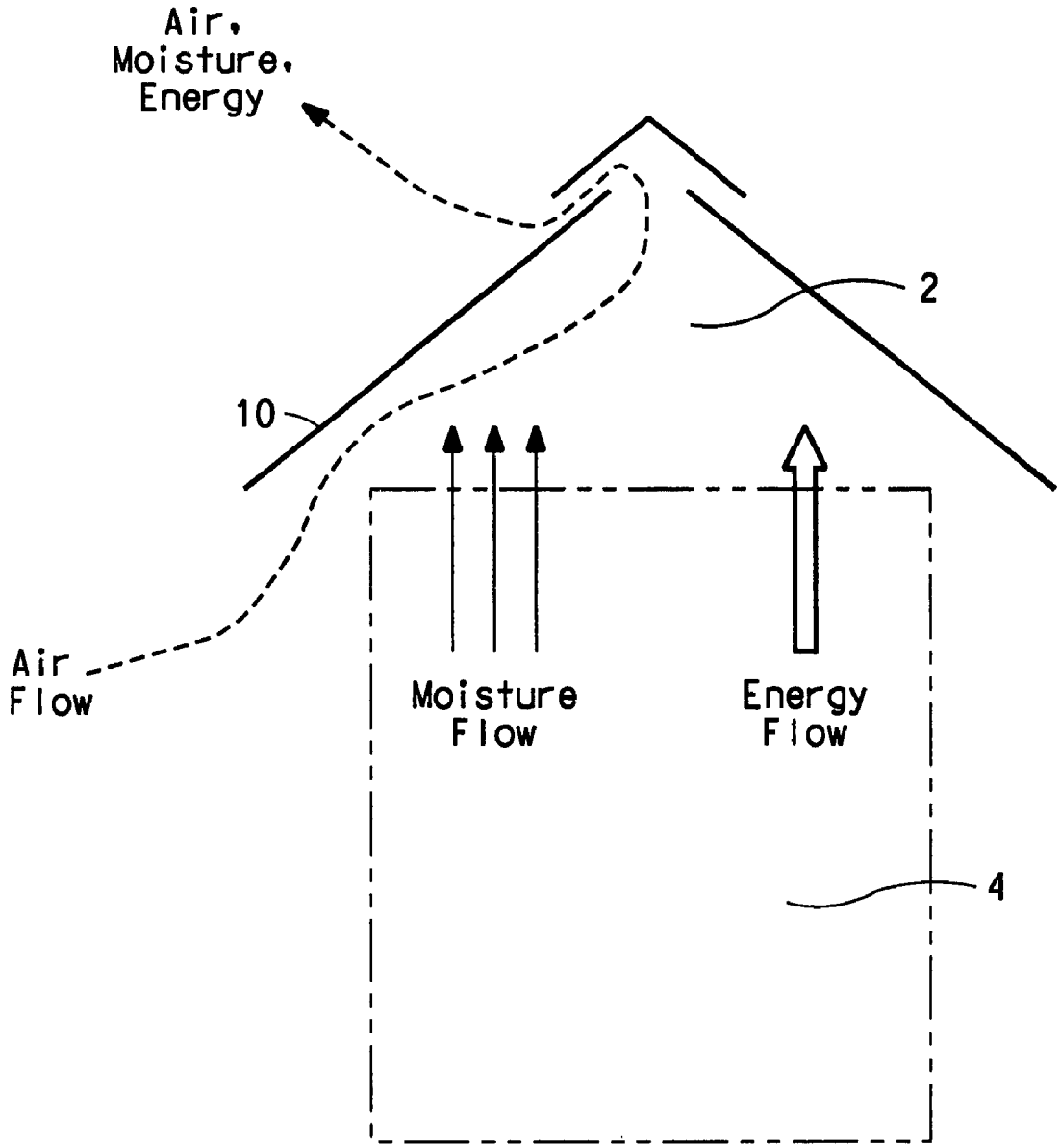
FIG. 1 (prior art) is a cross-sectional view of a house illustrating conventional residential construction.
Figure 2:
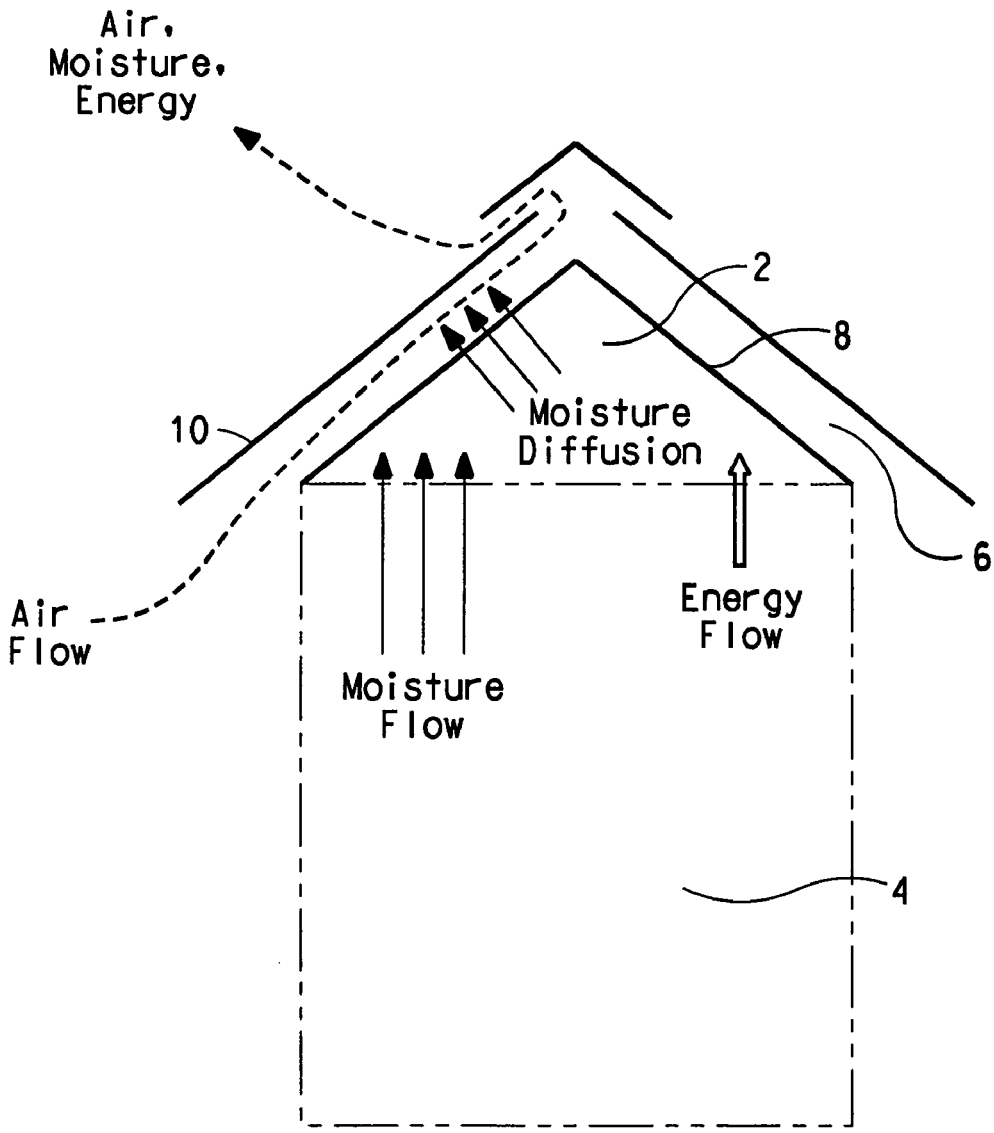
FIG. 2 is a cross-sectional view of a house having a breathable membrane installed such that an active air space is provided between the membrane and the roof decking, and the attic is sealed, according to the present invention.

The method of the invention provides an active air space directly below the roof deck for the active flow of air entering the air space at the eaves and exiting the building at the roof ridge. As shown in FIG. 2, the active air space 6 is the space between breathable membrane 8 and roof deck 10. The active air space 6 removes water vapor to avoid moisture building up in the wood of the rafters and roof deck. The method of the invention also seals the attic 2, thereby minimizing air exchange between the living space 4 and the attic and providing considerable energy savings to the building owner. Some energy is still allowed to escape through the ridge vent, but less than in prior art construction methods.

Figure 3B:
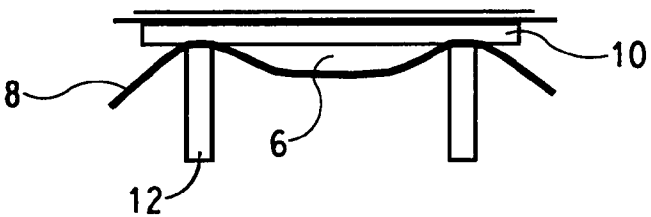
FIG. 3B is a cross-sectional view of a roof through the cross-section of the roof rafters illustrating the same method for installing the breathable membrane as shown in FIG. 3A.
Figure 3A:
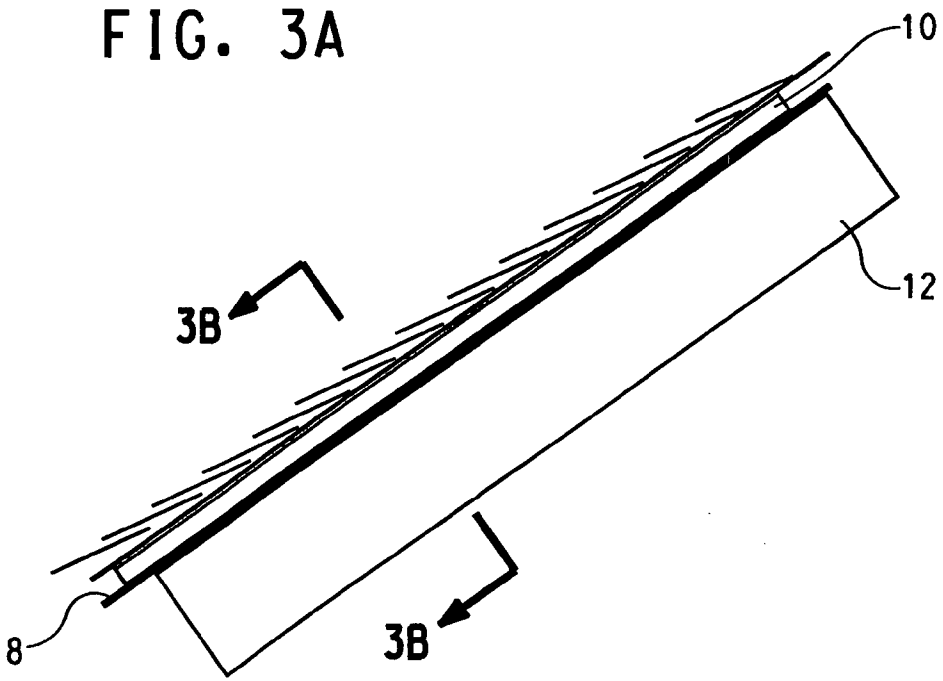
FIG. 3A is a cross-sectional view of a roof along the length of the roof rafters illustrating one method for installing the breathable membrane.

In one embodiment of the invention, as shown in FIGS. 3A and 3B, a breathable membrane 8 is installed on top of the rafters 12 such that sufficient slack in the membrane drapes down between adjacent rafters to create an active air space 6, i.e., the air gap between the membrane and the roof deck 10 between adjacent rafters. Preferably, the height of the air space, i.e., the distance between the roof deck and the membrane, is between about ½ inch (1.3 cm) and about 2 inches (5 cm). This method works well for simple roof designs such as straight, gabled roofs, having no hips or valleys. If this method is used on complex roof designs having hips and/or valleys, careful installation is required in order to provide a uniform air space.

Figure 4B:
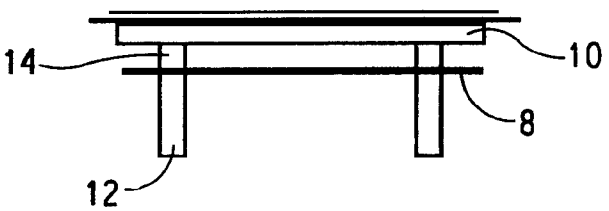
FIG. 4B is a cross-sectional view of a roof through the cross-section of the roof rafters illustrating the same method for installing the breathable membrane as shown in FIG. 4A.
Figure 4A:
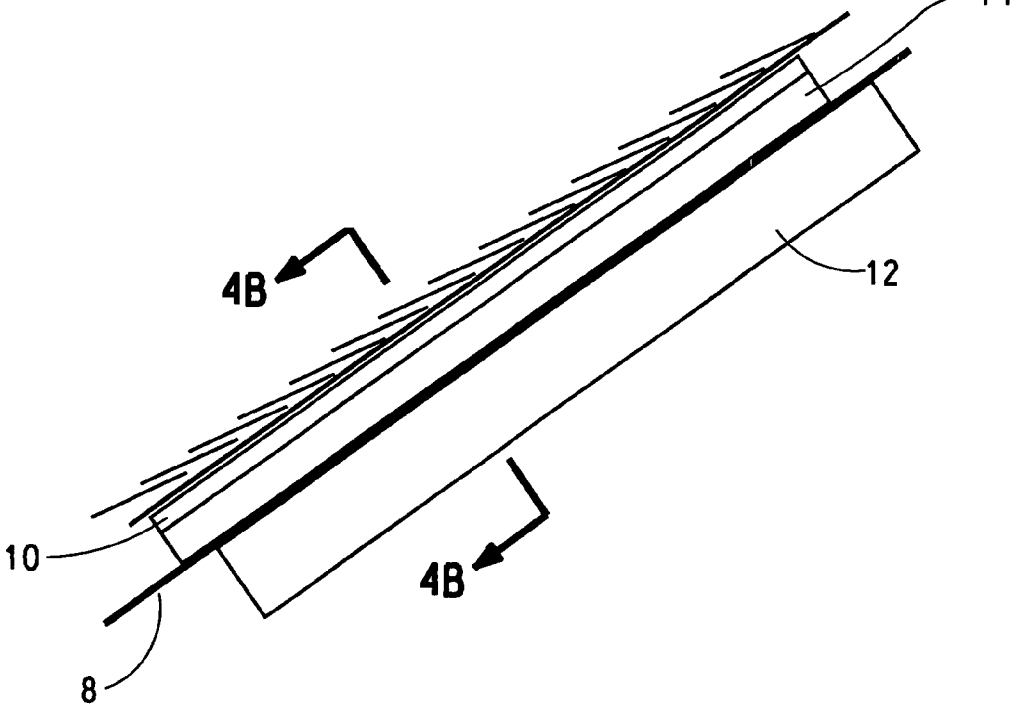
FIG. 4A is a cross-sectional view of a roof along the length of the roof rafters illustrating one method for installing the breathable membrane.

In another embodiment of the present invention, as shown in FIGS. 4A and 4B, another method is used to create the active air space below the roof deck. A breathable membrane 8 is installed over the rafters 12, tightly with no slack. Counter battens 14 are positioned directly over the membrane and above the rafters and fastened to the rafters through the membrane. The roof deck 10 is then installed above the counter battens. The height of the counter battens determines the distance between the roof deck and the membrane and therefore the height of the air space 6 below the roof deck. The counter battens are preferably about 0.5 inch (1.3 cm) to about 2 inches (5 cm) in height when installed wherein the distance between the roof deck and the membrane is sufficient to allow air to flow freely through the air space. This method works well with all roof types, including complex roof designs having hips and valleys.

In both of the embodiments described above, the attic is sealed around the perimeter of the building. The attic can be sealed by slitting the breathable membrane at the eave and taping it over the peripheral building wrap, or if no building wrap is used, by taping it to the exterior of the peripheral walls of the building. The breathable membrane seals the roof rafters to the exterior of the peripheral walls so that there is no open air gap between the attic and the exterior of the building. Sealing the attic in this way has been found to provide significant energy savings since the air flowing through the active air space between the membrane and the roof deck is primarily air which enters at the eaves, not air which is drawn from the attic or living space beneath the attic as occurs with conventional, unsealed attics.

In the embodiments described above, the breathable membrane is installed above the roofing rafters. The present inventor believes that the same benefits could be obtained if the breathable membrane were installed directly above the attic "floor," however, because of conventional building practices in which wires, duct work, etc., are installed at this location, it is difficult and less desirable to seal the membrane at this location.

The breathable membrane can be any vapor permeable material, preferably having a moisture vapor transmission rate of at least about 20 US perms according to ASTM E96 Method A. The breathable membrane allows moisture to diffuse through it from the attic space into the active air space where moisture is carried by the flowing air to the exterior through the ridge vent. Preferably, the breathable membrane is durable and UV resistant. A preferred membrane has a tensile strength (according to ASTM test method D828) of at least about 34 lb/in (59 N/cm) in the machine direction and about 30 lb/in (52 N/cm) in the cross direction. More preferably, after exposure to 25 cycles of accelerated aging consisting of oven drying at 120° F. for 3 hours, immersion in water at room temperature for 3 hours and air-drying for 18 hours at room temperature (73° F.), the membrane does not lose strength. Also preferably, after exposure to UV radiation for 210 hours (10 hours/day for 21 days) with 5.0 Watts/$m^2$ irradiance at a wavelength of 315-400 nm, wherein the membrane is held at a distance of one meter from the UV source, at a membrane temperature of 140° F., the membrane does not lose strength and shows no visible signs of damage.

An example of a suitable breathable membrane is a two-layer composite sheet with Tyvek® HDPE (available from E. I. du Pont de Nemours and Company) as the inner layer and a durable spunbond polypropylene sheet as the outer layer. The composite sheet can be made by joining the two layers with an adhesive and subjecting them to a thermal calendering process. The temperature of the calendering process should be sufficient to melt the adhesive, and the nip pressure should be sufficient to force the molten adhesive around the fibers of the two layers to lock the two layers together mechanically and ensure high delamination strength of the composite sheet.

Other examples of materials suitable for use as the breathable membrane in the invention are spunbond polyolefin nonwoven sheets, including for instance a three-layer spunbonded polypropylene fabric such as the roofing underlayment sold under the trade name Roofshield® (available from the A. Proctor Group, Ltd., UK).

Other materials suitable for use as the breathable membrane are a nonwoven sheet comprising sheath-core bicomponent melt spun fibers, such as described in U.S. Pat. No. 5,885,909, herein incorporated by reference; and a composite sheet comprising multiple layers of sheath-core bicomponent melt spun fibers and side-by-side bicomponent meltblown fibers, such as described in U.S. Pat. Nos. 6,548,431, 6,797,655 and 6,831,025, herein incorporated by reference. For instance, the bicomponent melt spun fibers can have a sheath of polyethylene and a core of polyester. If a composite sheet comprising multiple layers is used, the bicomponent meltblown fibers can have a polyethylene component and a polyester component and be arranged side-by-side along the length thereof. Typically, the side-by-side and the sheath/core bicomponent fibers separate layers in the multiple layer arrangement.

EXAMPLES

Three residential construction sites located in Calgary, Alberta, and Prince Edward Island in Canada and Jackson, Wis. in the United States were identified for the installation of a breathable membrane according to the invention. In each house, the attic space was sealed with a DuPont Tyvek® Supro Style 2506B breathable membrane having a basis weight of 150 g/$m^2$ and a moisture vapor transmission rate of 71.4 US Perms. An active air space was created above this installed membrane and below the roof deck.

In each of the three houses, the membrane was laid tightly over the top of the rafters. Wooden counter battens were then secured using nails and/or staples directly over and aligned with the rafters. In two of the three houses, the counter battens had cross-sectional dimensions of about 1⅝ in (4.13 cm) by about 1⅝ in (4.13 cm). In the other house, the counter battens had a height (perpendicular to the roof deck) of about 1⅝ in (4.13 cm) and a width (parallel to the roof deck) of about 3⅝ in (9.21 cm). The roof deck was attached over the counter battens. The counter battens created an active air space between the membrane and the decking. The counter batten was terminated about 1-2 inches (2.5-5 cm) away from the hip or valley to allow air flow to the ridge vent.

It was observed that no moisture accumulated in any of the attics of the three houses. Typically, all wooden members in the attic were inspected for mold, water, or evidence of moisture condensation. The breathable membrane was also inspected for evidence of condensation. In some cases, the breathable membrane was slit to look into the air space between the membrane and the roof deck for evidence of condensation. These inspections were typically held about 6 months after completion (in the winter months for the cold climate).

What is claimed is:

1. A breathable membrane in a building, comprising peripheral walls, a roof deck and a roof comprising rafters having a ridge vent at the highest portion of the roof and eaves at the lowest portion of the roof, wherein the membrane is installed over the rafters in a manner to provide an active air space between the membrane and the roof deck wherein the active air space is open to the exterior of the building at the eaves and at the ridge vent of the building.

2. The membrane of claim 1, having a permeability greater than about 20 US perms.

3. The membrane of claim 1, comprising a two-layer composite sheet of a flashspun high-density polyethylene sheet and a spunbond polypropylene sheet.

4. The membrane of claim 1, comprising a flashspun high-density polyethylene sheet.

5. The membrane of claim 1, comprising a nonwoven sheet of sheath-core bicomponent melt spun fibers, wherein the sheath is polyethylene and the core is polyester.

6. The membrane of claim 1, comprising a composite of a layer of sheath/core bicomponent melt spun fibers and a layer of side-by-side bicomponent meltblown fibers, wherein the bicomponents are polyethylene and polyester and the sheath is polyethylene and the core is polyester in the sheath/core bicomponent.

7. The membrane of claim 1, comprising a three-layer spunbonded polypropylene fabric.

* * * * *